US007275492B2

(12) United States Patent
Jungblom et al.

(10) Patent No.: US 7,275,492 B2
(45) Date of Patent: Oct. 2, 2007

(54) ANCHOR ROPE LOCK

(76) Inventors: Eric Jungblom, 1916 Conifer Dr., Ferndale, WA (US) 98248; Fred Lee Blake, 1916 Conifer Dr., Ferndale, WA (US) 98248

( * ) Notice: Subject to any disclaimer, the term of this patent is extended or adjusted under 35 U.S.C. 154(b) by 12 days.

(21) Appl. No.: 11/350,521

(22) Filed: Feb. 8, 2006

(65) Prior Publication Data

US 2006/0174811 A1 Aug. 10, 2006

Related U.S. Application Data

(60) Provisional application No. 60/651,381, filed on Feb. 8, 2005.

(51) Int. Cl.
*B63B 21/22* (2006.01)

(52) U.S. Cl. ..... 114/210

(58) Field of Classification Search ..... None
See application file for complete search history.

(56) References Cited

U.S. PATENT DOCUMENTS 1,779,430 A 10/1930 Gronquist
2,547,370 A * 4/1951 Boyer ..... 24/134 R
2,938,491 A * 5/1960 Scanlin ..... 114/210
3,626,888 A * 12/1971 Cameron et al. ..... 114/199
3,843,999 A * 10/1974 Kramoski ..... 114/199
4,362,119 A * 12/1982 Thimander ..... 114/210
5,062,375 A * 11/1991 Makielski ..... 114/210

* cited by examiner

*Primary Examiner*—Lars A. Olson
(74) *Attorney, Agent, or Firm*—Todd N. Hathaway

(57) ABSTRACT

An anchor rope lock that locks the rope in response to tension exerted by the anchor, and that unlocks the rope for retrieval or adjustment in response to tension applied to the free end. A locking shoe is mounted on a horizontal pivot axis for pivoting towards locked and unlocked positions. The rope passes under a lower surface of the shoe and upwardly through a passage in a projecting toe portion. As the shoe pivots towards the locked position, the lower surface of the shoe moves towards the upper surface of an underlying base plate so as to compress the rope, and the passage in the toe of the shoe moves towards a vertical orientation so as to force the rope into a bend so that the anchor rope is held firmly at a fixed length. When reverse tension is applied to pivot the shoe towards the unlocked position, the lower surface of the shoe moves away from the surface of the base plate so as to release the rope and the passage in the toe portion moves towards a horizontal orientation so as to straighten the bend, so that the rope can be selectively retracted or extended through the lock assembly. From the shoe, the rope exits the top of the toe portion and is directed over a fairlead towards the anchor end. The greatest part of the weight of the shoe is located on the side of the pivot axis opposite the toe portion, so that the weight urges the shoe towards the locked position.

16 Claims, 3 Drawing Sheets

ANCHOR ROPE LOCK

RELATED APPLICATIONS

This application claims the benefit of U.S. Provisional Patent Application No. 60/651,381 filed on 8 Feb. 2005.

BACKGROUND a. Field of the Invention

The present invention relates generally to boat anchors and anchor lines, and more particularly, to an anchor rope lock that locks the line in position in response to tension exerted by the anchor and which releases the line for adjustment/retrieval in response to pulling on free end thereof.

b. Related Art

Recreational boats and other small craft commonly use anchor lines formed of rope (synthetic or natural fiber), as opposed to the anchor chains sometimes found on larger craft. When the anchor is set, the rope is typically secured to the craft by being wrapped about a cleat, post or similar fitting. Although simple and effective, these traditional techniques are less than satisfactory under some circumstances.

In particular, undoing a rope from a cleat or similar fitting in order to raise/lower the anchor, and then securing the line again, is a slow and tedious process, especially under circumstances where this must be done on a frequent basis rather than only once or twice each outing. Moreover, the operator must ordinarily stand close to or over the cleat or other fitting, so that his hands can loop/wind the rope over and around the fitting, so that this task cannot be accomplished while seated or otherwise located at a point remote from the fitting where the operator may wish to remain.

The circumstances described in the preceding paragraph are, for example, characteristic of fishing from a drift boat, jet boat, river sled, or other small craft in a running river. As is well known, this type of fishing commonly requires that the boat be held stationary in selected positions at certain points and at certain times, and that these positions be frequently adjusted. For example, the anchor will often be raised and lowered over short periods, alternately holding the boat in position and then allowing it to drift for a short distance, while trying various holes, ripples and other features. Moreover, even when a hole or other feature is fished for an extended period of time, it is frequently necessary to adjust the length of the anchor line in order to adjust the position of the boat relative to the feature or to permit the fisherman to fight a fish. The need for frequent adjustments is compounded by the changing depths and currents that are characteristics of most such rivers.

Since the anchor line chalk/fairlead and cleat are normally located at one end of the boat (typically, the bow end), the operator must each time put down his fishing gear and get up and leave the seating area in order to adjust or retrieve the anchor line. Not only is this disruptive and inconvenient, but it may in some instances present safety concerns due to the hazards inherent in having to repeatedly move about in a small boat on a river.

However, there has heretofore been an absence of satisfactory alternatives to cleats and other traditional deck fittings. Cam cleats (in which the rope is gripped between a pair of spring-loaded jaws having serrated teeth), although widely used for sheets and other running rigging on sailboats, do not offer a sufficiently positive locking action, owing the inherent potential for the rope to jump upwardly from between the jaws; in a strong river current, any failure to hold the anchor line securely presents the potential for a serious and possibly life threatening accident. Moreover, the mechanisms of cam cleats in general are not suited to the harsh service environment (e.g., exposure to sand/gravel, impact damage and so on) typical of use on a river, and moreover tend to damage the rope when subjected to the heavy tension loads that can be expected with an anchor line.

Another device is the anchor rope lock that is shown in U.S. Pat. No. 1,779,430 (Gronquist). This and like devices have been sold for many years and are generally adequate for light duty applications, such as anchoring a canoe, kayak or rowboat on a lake or in other quiet waters. Again, however, these devices have not been suited for use with larger craft on running rivers. The action of the "pendulum" mechanism is insufficiently positive, so that it will not operate to lock the rope if even slight back tension is exerted on the free end of the line; this makes it very difficult to adjust the length of the anchor under situations where (as in a river) the line is subject to heavy strain/tension. Moreover, the locking action depends solely on a sharp "kink" that is formed where a very short section of the rope passes through a ring at the end of the pendulum; this is insufficiently positive to prevent the rope from slipping through the ring under high loads, especially as stretching/elongation of the rope occurs (which is common with synthetic fiber lines), or if the edges of the ring are worn smooth. This feature also tends to cause excessive wear and damage to the rope, where the sharp edges of the ring dig into the fibers of the "kinked" area.

Accordingly there exists a need for an apparatus for securing an anchor line that can be operated from a position remote from the apparatus without the operator having to rise from and leave a seating area or other location used for fishing or the like. Furthermore, there exists a need for such an apparatus that has a locking action sufficiently positive to obviate potential slippage of the anchor line under the heavy tension loads encountered during river fishing. Still further, there exists a need for such an apparatus that enables the operator to adjust the length of the anchor line in a smooth and easily controlled manner under a variety of load conditions. Still further, there exists a need for such an apparatus that will not cause excessive wear and damage to the rope during use. Still further, there exists a need for such an apparatus that has a mechanism that is durable and long lasting under the severe operating conditions typically encountered by craft used for river fishing.

SUMMARY OF THE INVENTION

The present invention has solved the problems cited above, and is an anchor rope lock, comprising broadly: (a) a stationary base plate having an upper surface for passage of the anchor rope in a generally horizontal direction thereover; (b) a pivoting locking shoe for engaging the anchor rope so that the shoe pivots about a generally horizontal axis towards a locked position in response to tension applied to an anchor end of the rope and towards and unlocked position in response to tension applied to a free end of the rope, the locking shoe comprising: a lower surface that moves towards the upper surface of the base plate so as to compress the rope as the rope pivots towards the locked position, and then moves away from the upper surface of the plate so as to release the rope as the shoe pivots towards the unlocked position; and a passage extending generally normal to the lower surface that moves towards a vertical orientation so as to force the rope into a bend as the shoe pivots towards the locked position, and that moves towards a horizontal orientation so as to straighten the bend as the shoe pivots towards the unlocked position; and (c) a fairlead that directs the anchor rope from the passage in the shoe towards the anchor end of the rope.

The locking shoe may further comprise a body portion having the horizontal pivot axis proximate an upper end thereof, and the lower surface on a lower end thereof. The passage in the shoe may be located on a side of the body portion that is towards the fairlead when the shoe is in a locked position, so that the rope passes under the lower end of the body portion and is directed towards the fairlead from an upper end of the passage.

The greatest portion of the weight of the body portion of the shoe may be located on a side of the body portion that is away from the fairlead when the shoe is in the locked position, so that the weight of the body portion urges the shoe to pivot downwardly from the unlocked position towards the locked position. The body portion may comprise a block-shaped body having the horizontal axis at an upward corner thereof. The block-shaped body may comprise a block-shaped weight formed of substantially solid metal.

The locking shoe may further comprise a toe portion that projects from the lower end of the body portion and that has the passage formed therein. The toe portion may comprise an upper side at which the anchor rope exists the passage towards the fairlead, and the fairlead may comprise a rope-supporting portion that is elevated above the upper side of the toe portion so that the rope tends at an upward angle therefrom. The rope supporting portion of the fairlead may comprise the sheave of a roller fairlead.

The toe portion of the locking shoe may comprise a lower surface that extends from and is substantially continuous with the lower surface on the body portion of the shoe. The upper surface of the base plate may be substantially flat and horizontal, and the lower surfaces of the body and toe portions of the locking shoe may be curved so as to diverge upwardly from the surface of the base plate towards a distal end of the toe portion when the shoe is in the locked position. The lower surface on the body portion may further comprise an angled corner at an end of the lower surface opposite the toe portion of shoe, for pressing into the rope thereunder when the shoe is in the locked position.

The passage in the toe portion of the locking shoe may extend in a substantially vertical direction perpendicular to the upper surface of the base plate when the shoe is in the locked position. The toe portion may further comprise an inside chamfer at an upper end of the opening for protecting the rope from damage against the opening.

In a preferred embodiment, the invention provides an anchor rope lock, comprising: (a) a frame, comprising: an elongate base plate having a substantially flat, horizontal upper surface for passage of an anchor rope thereover in a generally horizontal direction; and first and second substantially parallel, spaced apart side plates mounted to the base plate so as to extend upwardly therefrom, so that in combination the base and side plates define an elongate channel; (b) a locking shoe mounted between the side plates on a horizontal pivot proximate a first end of the elongate channel, the locking shoe comprising: a block-shaped, substantially solid body portion having the pivot axis at an upper corner thereof so that the greatest portion of weight of the locking shoe is located on a side of the pivot axis towards the first end of the channel; a shallow toe portion protruding from the lower end of the body portion towards a second end of the channel; a lower surface formed on the lower end of the body portion and the toe portion for compressing the rope against the upper surface of the base plate when in the locked position, the lower surface facing towards the upper surface of the base plate when the shoe is in the locked position and curving upwardly therefrom towards a distal end of the toe portion; and a passage through the toe portion for forcing the rope into a bend when the shoe is in the locked position, the passage extending in a generally vertical direction substantially perpendicular to the upper surface of the base plate when the shoe is in the locked position; and (c) a fairlead roller mounted between the side plates on a horizontal axle proximate the second end of the channel, the fairlead roller comprising: a sheave that is elevated relative to the locking shoe so that the rope tends at an upward angle from the distal end of the toe portion of the locking shoe to the sheave of the fairlead roller where the shoe is in the locked position.

The invention further provides a locking shoe for an anchor rope lock, the locking shoe comprising: (a) a block-shaped, substantially solid body portion having a horizontal pivot axis at an upper corner thereof so that a greatest portion of weight of the locking shoe is on a first side of the pivot axis; (b) a shallow toe portion protruding from a lower end of the body portion on a second, opposite side of the pivot axis; (c) a lower surface formed on a lower end of a body portion and the toe portion for compressing an anchor rope thereunder, the lower surface curving upwardly toward a distal end of the toe portion; and (d) a passage through the toe portion for forcing the rope into a bend, the passage extending in a direction generally normal to the lower surface of the body portion of the shoe.

The body portion may further comprise a lower corner opposite the corner having the pivot axis, that forms an angled corner at an end of the lower surface of the shoe for pressing into the rope as the rope is compressed thereunder.

These and other features and advantages of the invention will be more fully understood from a reading of the following detailed description with reference to the accompanying drawings.

DETAILED DESCRIPTION

Figure 1:
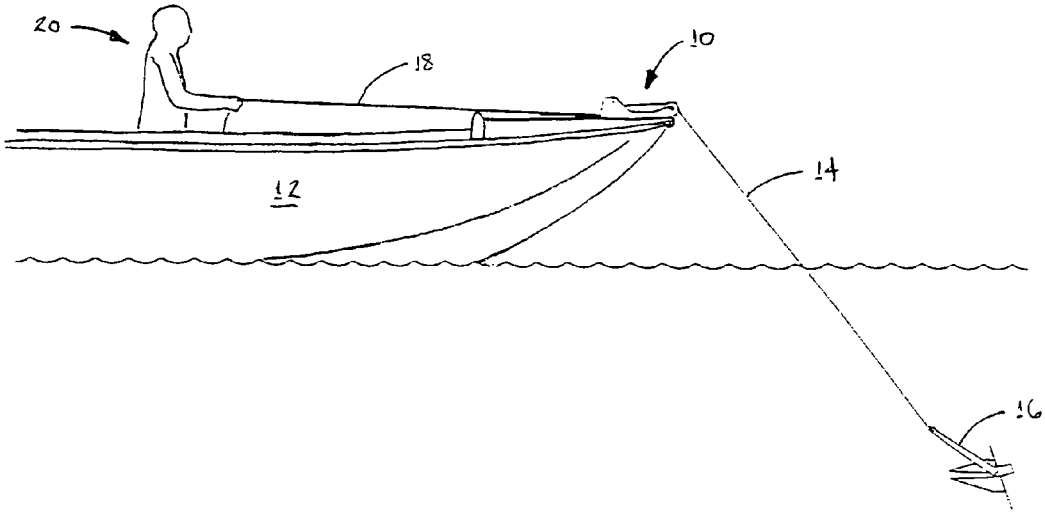
FIG. 1 is an elevational, environmental view of a boat having an anchor line lock in accordance with the present invention mounted thereto, showing the manner in which this allows an operator to adjust the anchor line from a location in the boat remote from that of the lock apparatus.

FIG. 1 shows an anchor line lock assembly 10 in accordance with the present invention, mounted to the bow of an exemplary boat 12. As can be seen, the anchor line 14 is routed through the lock assembly 10 from an outboard end that is secured to an anchor 16, to a free end 18 that is located within the boat itself. As will be described in greater detail below, the mechanism of the anchor rope lock 10 allows the anchor line to be adjusted or retrieved by an operator 20 who is standing/sitting at a location in the boat remote from the position of the lock assembly itself, without having to move about or leave a position that has been selected for fishing or another purpose.

Figure 2:
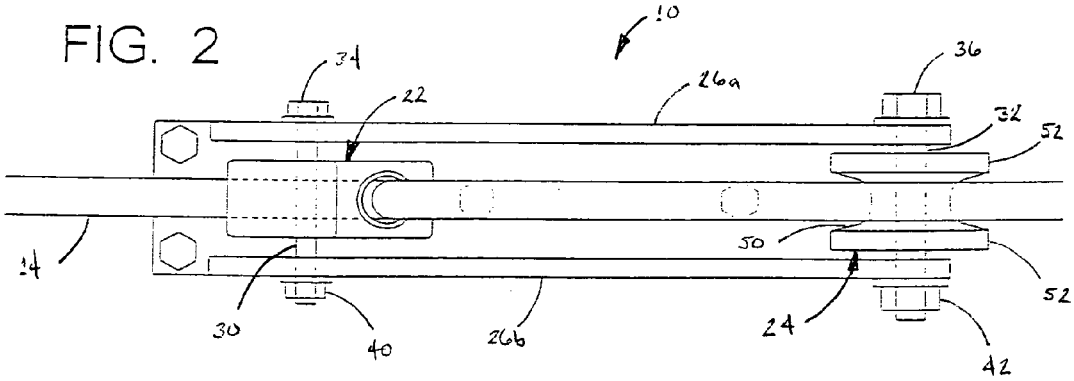
FIG. 2 is a top, plan view of the anchor line lock of FIG. 1, showing the path of the anchor rope therethrough and the linear relationship between the pivoting locking shoe and the fairlead over which the rope passes to the anchor.
Figure 3:
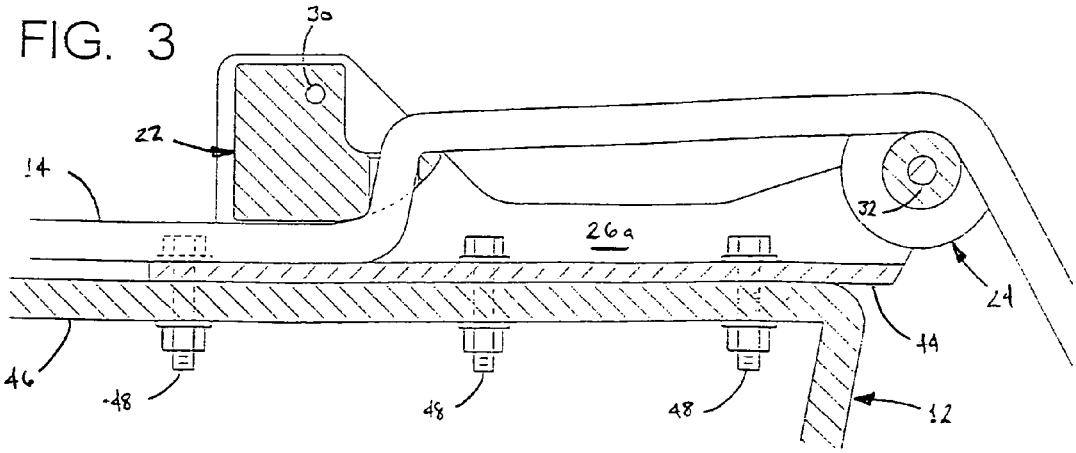
FIG. 3 is a side, cross-sectional view of the anchor line lock of FIGS. 1-2, showing the upward, generally vertical path of the rope through the passage in the shoe when the latter is in the locked position, and from the shoe forward over the fairlead to the anchor end of the rope.

As can be seen in FIGS. 2-3, the anchor rope lock assembly 10 includes a pivoting locking shoe 22 and a roller fairlead 24 that are mounted between upwardly extending side plates 26*a*, 26*b* on axles 30, 32. In the embodiment that is illustrated, the axles are provided by the shafts of bolts 34, 36 that pass between and through the two side plates and that are secured by nuts 40, 42 threaded on their distal ends. This configuration is durable and facilitates repair/replacement of parts, if necessary, however it will be understood that other forms of axles and pivot pins may be used.

The side plates are mounted to a common base plate 44 that extends across the bottom of the assembly so that in combination with these side plates form a rigid, channel-shaped frame. As shown in FIG. 3, when the side plates elevate the axles 30, 32 sufficiently above the base plate 44 to provide clearance for pivoting/rotating movement of the shoe and fairlead, as will be described in greater detail below. The base plate 44, in turn, provides an upper surface for engaging the anchor rope, as well as a comparatively broad, stable base for mounting to the deck 46 or other suitable surface on the boat. For example, the base plate may be mounted to the boat by welding, or by bolts 48 or other fasteners passing vertically therethrough as shown in FIG. 3; as noted above, the block assembly will normally be mounted on the bow of the boat, hence for ease of illustration, the term "forward" will be used from time-to-time herein to refer to the direction towards the fairlead at the distal end of the assembly, however, it will be understood that the assembly can be installed at any suitable location on the craft.

As noted above, the two rotating/pivoting components of the rope lock assembly are the fairlead roller 24 and locking shoe 22. In the preferred embodiment that is illustrated, the fairlead roller employs a generally conventional sheave wheel roller having a rope groove 50 planked by circumferential flanges 52; it will be understood, however, that other types of rollers, or even non-roller fairleads, may be used in some embodiments.

Figure 5:
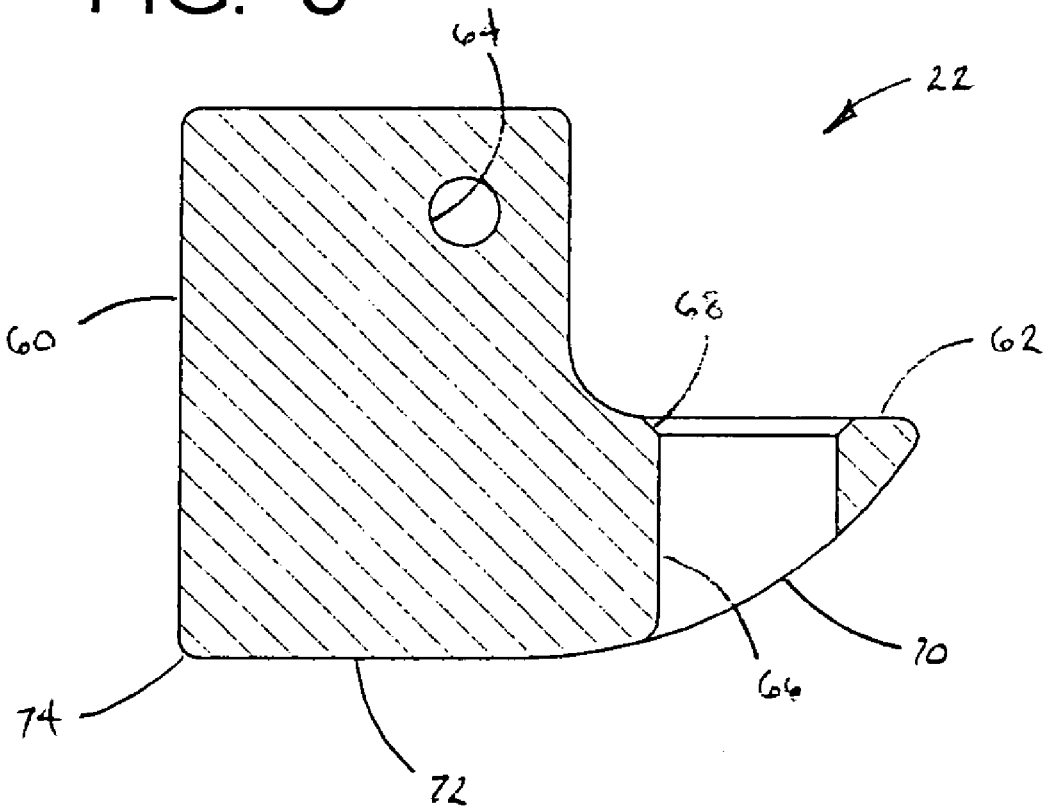
FIG. 5 is a side, cross-sectional view of the locking shoe of FIG. 4, showing the relationship between the pivot axis and the other portions of the shoe in greater detail.

The locking shoe 22, in turn, is somewhat L-shaped member having a vertically elongate, rectangular, block-shaped body 60 with a toe portion 62 extending forwardly from a lower end thereof. As can be seen, the top of the toe portion 62 is located somewhat below the vertical midpoint of the shoe, i.e., well below the top of the block-shaped body. A transverse bore 64 for the pivot shaft 30 is formed proximate the upper, forward corner of the body 60, so that when it is vertically oriented (as shown in FIG. 5) the main mass/weight of the body is located to the rear of the bore, i.e., on the side of the bore opposite the toe portion 62. A large-diameter bore 66 is formed vertically through the toe portion to accommodate passage of the anchor rope therethrough; as will be described in greater detail below, the bore extends generally normal to the lower surface of the body position that bears against there rope, and includes a countersink at its upper end for minimizing wear/damage to the rope when in the locked position.

The locking shoe 22 is preferably formed of a solid, comparatively dense material (e.g., machined aluminum alloy or other metal). It will therefore be appreciated (e.g., from the position of the transverse bore 64 and the amount of material removed from the toe portion 62 by the vertical passage 66), that the greatest part of the weight of the shoe is located behind the transverse bore, i.e., on the opposite side from the toe portion. Consequently, when suspended from the pivot axle 30, the weight of the body portion will tend to force the bottom of the locking shoe in a forward direction (i.e., in a counterclockwise direction in FIG. 5), towards the locked position. Moreover, it will be understood that the more the bottom of the shoe is pivoted to the rear (i.e., in a clockwise direction as seen in FIG. 5), the greater the relative mass of the locking shoe that is positioned behind/above the pivot point and therefore the greater the force tending to return the shoe to the locked position. It will also be understood that in some embodiments other configurations (e.g., extensions to the rear of the shoe or added weights) may be used to achieve or enhance this effect.

As can be seen with further reference to FIG. 5, the lower surface 70 of the toe portion is continuous with the lower surface 72 of the body and curves upwardly and forwardly therefrom. The lower surface of the body portion that bears against the rope may be generally flat as shown in the figures, or may have a curvature that continues into the toe portion. In the illustrated embodiment, the radius of curvature preferably increases from the base of the toe portion towards the distal end (point): In the example that is shown, the radius of curvature at the base of the toe portion (where it meets the bottom surface 72 of the body) is approximately 1.66 inches, at the midpoint it is about 1.75 inches, and at the distal end it is about 1.84 inches. The bottom surface 72 of the body portion, in turn, terminates in a radiussed corner 74 opposite the distal end of the toe portion; the radius of curvature of corner 74 serves to prevent damage to the rope, yet is sufficiently small (sharp) to avoid slippage when in the locked position, as will be described below.

Figure 4:
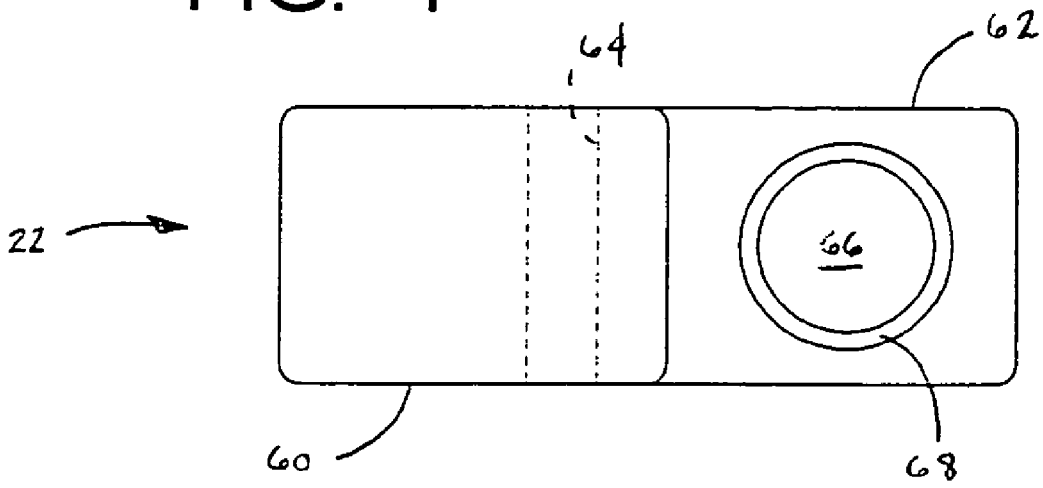
FIG. 4 is a top, plan view of the locking shoe of the anchor rope of FIGS. 1-3, showing the shoe in enlarged detail.

By way of illustration, exemplary dimensions for a locking shoe in accordance with the embodiment which is shown in FIGS. 4-5, for use with an approximate ½-inch diameter rope, are set forth in the following table:

TABLE A

| | |
|---|---|
| Height of Body Portion | 2 inches |
| Length of Body Portion (Front to Rear) | 1⅜ inches |
| Width of Body Portion | 1 inch |
| Height of Pivot Bore | 1⅝ inches |
| Distance of Pivot Bore from Rear of Body | 1 inch |
| Diameter of Pivot Bore | ¼ inch |
| Length of Toe Portion (Front to Rear) | 1³⁄₁₆ inches |
| Height of Toe Portion (maximum) | ⅞ inch |
| Diameter of Rope Passage | ⅝ inch |
| Rope Passage Chamfer | 45° |
| Weight | 5¾ ounces |
| Material | Aluminum Alloy |

It will be understood that the foregoing table sets forth the dimensions of only one example of locking shoe in accordance with a preferred embodiment of the invention, and that other dimensions may be used depending on materials, body shape, rope size, expected loads and other design factors. For example, the sizes of the shoe and other components can be suitably increased for use with approximate ⅝-inch diameter lines, which is the second size (in addition to ½-inch ropes) most commonly used for drift boats and similar craft.

As can be seen in FIG. 2, the locking shoe and fairlead are mounted between the side plates 26*a*, 26*b* of the frame so as to be substantially aligned in a vertical plane. In side view as seen in FIG. 3, however, the rope follows a somewhat sinuous path, first passing under and through the locking shoe and then over the fairlead to the outboard end that is attached to the anchor.

As can be seen in FIG. 3, the free end of the rope passes under the locking shoe, between the bottom surface of the body of the shoe and the top surface of the base plate 44. The locking shoe is supported by the pivot pin 30 at a height such that the bottom surface of the body, when horizontal, is spaced above the surface of the baseplate by a distance just slightly greater than the largest size of rope with which the locking assembly is intended to be used; for example, in an embodiment that is intended to be used with an approximate ½-inch diameter rope (see Table A above), the vertical gap is suitably about 9/16 inch. Consequently, due to the weight distribution of the locking shoe relative to the axis of the pivot pin 30, this ensures that the shoe will always be angled toward the locked position (i.e., in a counterclockwise direction in FIG. 3), whether it is used with the maximum size of rope or a somewhat smaller (e.g., ⅜ inch) line.

Figure 6:
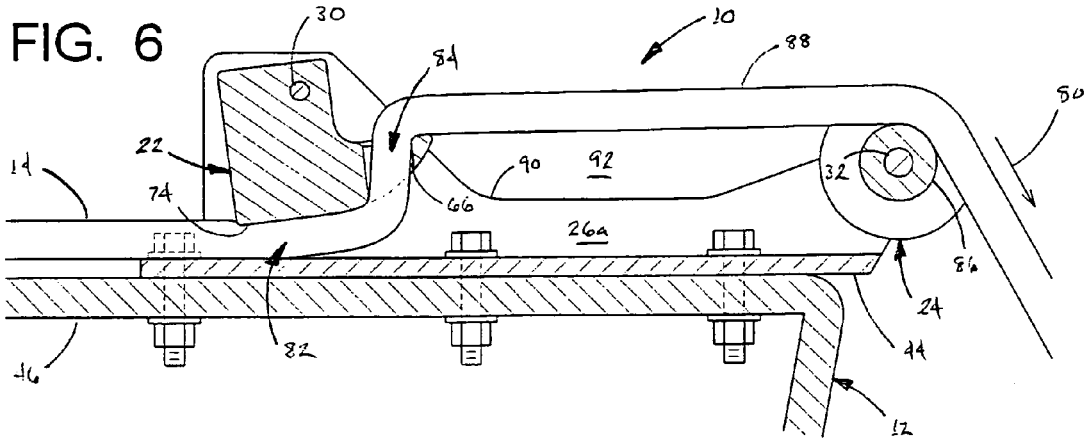
FIGS. 6-8 are side, cross-sectional views of the lock assembly of FIG. 1, similar to FIG. 3, showing the action of the pivoting locking shoe when the anchor line is locked and when the line is being retrieved/adjusted.

Thus, when tension is applied to the outboard end of the rope by the anchor (as indicated by arrow 80 in FIG. 6) and back tension on the free end is released, the combination of friction against the rope and the distribution of weight to the rearward side of the locking shoe causes the shoe to pivot forcefully towards the locked position, will be pivoted downwardly by its weight so that the lower surface 72 and rearward corner 74 engage and press downwardly against the top of the rope, compressing the latter between the shoe and base plate 44 in the area indicated at 82 in FIG. 6. As this is done, the radius of the corner 74 avoids causing damage to the fibers of the rope. At the same time, the frictional engagement that is thus established between the bottom surface of the shoe and the rope ensures that any increased tension on the rope will cause the shoe to pivot yet further towards the locked position, further increasing the clamping force that is exerted against the rope.

From under the body of the shoe, the rope extends along the lower surface 70 of the toe portion (see FIG. 5), and then upwardly through the bore of the passage 66. Since the passage is aligned in an upward, generally vertical direction when the shoe is in the locked position, the rope is forced into a "kinked" configuration in the area 84 indicated in FIG. 6. However, as compared with the prior devices described above, wear and damage to the rope are minimized owing to the greater distance between the two bends of the "kink" and the protection afforded by the curved lower surface at the bottom and chamfer opening at the top of the toe portion 62.

From the top opening of the passage 66, the rope is lead forward across the top surface of the toe portion of the shoe and then over the fairlead roller 24. As can be seen with further reference to FIG. 6, the fairlead roller is mounted to the sidewalls by axle 32 at a height such that when the rope passes over the sheave 86 thereof, the bight 88 of rope forward of the locking shoe tends at an upward angle toward the roller. This serves to prevent the bight of rope from contacting and pressing against the distal tip of the toe portion 62 in a manner that would interfere with the shoe rotating into the locked position.

As can also be seen in FIG. 6, the upper edges 90 of the two sidewalls 26*a*, 26*b* are preferably cut down to a level below that of the rope in the area between the locking shoe and the fairlead roller, thus forming a gap 92 through which the operator's fingers can be slipped in order to raise the anchor line by pulling on bight 88 rather than the free end of the rope, if desired.

When the assembly is in the locked position that is shown in FIG. 6, the grip that is established between the rope and the locking shoe at areas 82 and 84 holds the rope in an exceptionally positive and secure manner that virtually eliminates any potential for slippage. Prototype testing has in fact shown that, in general, the anchor connection and/or rope itself will fail before any significant slippage occurs.

Figure 7:
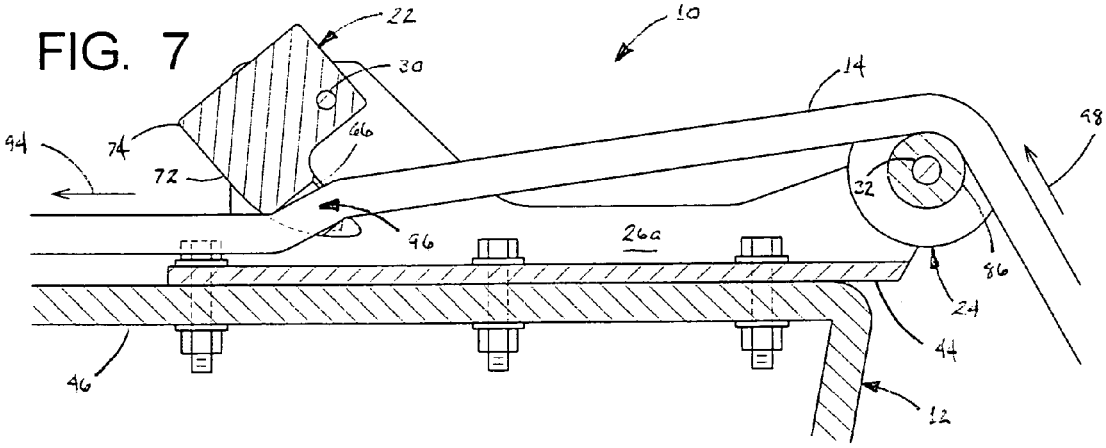

When the operator desires to adjust/retrieve the anchor line, however, the locking mechanism is very easily released simply by applying tension to the free end of the rope, in the direction indicated by arrow 94 in FIG. 7. As this is done, the frictional engagement between the rope and the bottom of the locking shoe at 22 causes the latter to pivot in a rearward direction (clockwise in FIG. 7), releasing the rope from compression. Further rotation moves the passage 66 in the toe of the shoe towards a horizontal orientation, straightening out the "kink" in the rope, as indicated at 96 in FIG. 7. The rope can thus slide freely through the passage 66, for example, to retract it in the direction indicated by arrow 98.

Figure 8:
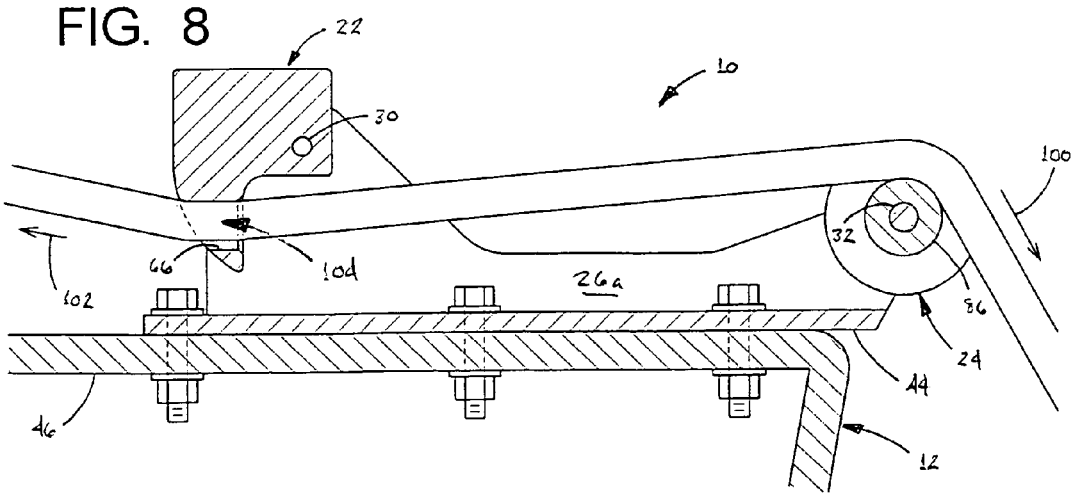

So long as sufficient back tension is exerted on free end of the anchor rope, the shoe 22 will be held in the unlocked position. Consequently, should the operator desire to increase the length of the anchor line, this can be done while the shoe is in the unlocked position by easing out the anchor line in the direction indicated by arrow 100 in FIG. 8. As this is done, the operator preferably lifts the free end of the line to an upwardly inclined angle (as shown), in order to maintain or increase the horizontal orientation of the passage 66 while at the same time maintaining a slight back tension on a free end of the rope as indicated by arrow 102.

The anchor line lock of the present invention thus permits convenient adjustment/retrieval of the anchor line from remote positions in the boat, simply by pulling and controlling the tension on the free end of the rope as shown in FIG. 1. Moreover, only two moving parts are used, and the components are strong and resistant to the wear and damage that can be expected when operating on a river or in other harsh environments. The components may be constructed of any suitable material, with aluminum alloy, stainless steel or other corrosion-resistant metals generally being preferred for reasons of strength, durability and superior wear characteristics. It will also be understood that the line lock and pivoting locking shoe may be modified or otherwise adapted to other applications, such as rescue/recovery work or repelling, for example.

It is to be recognized that various alterations, modifications, and/or additions may be introduced into the constructions and arrangements of parts described above without departing from the spirit or ambit of the present invention as defined by the appended claims.

What is claimed is:

1. An anchor rope lock, comprising:

a stationary base plate having an upper surface for passage of an anchor rope in a generally horizontal direction thereover;

a pivoting locking shoe for engaging said anchor rope so that said shoe pivots about a generally horizontal axis towards a locked position in response to tension applied to an anchor end of said rope and towards an unlocked position in response to tension applied to a free end of said rope, said locking shoe comprising:

a body portion having said axis proximate an upper end thereof;

a lower surface on a lower end of said body portion that moves towards said upper surface of said base plate so as to compress said rope as said shoe pivots towards said locked position and that moves away from said upper surface of said plate so as to release said rope as said shoe pivots towards said unlocked position;

a passage extending generally normal to said lower surface that moves towards a vertical orientation so as to force said rope into a bend as said shoe pivots towards said locked position, and that moves towards a horizontal orientation so as to straighten said bend as said shoe pivots towards said unlocked position; and a toe portion that projects from said lower end of said body portion and that has said passage formed therein; and a fairlead that directs said anchor rope from said passage in said shoe towards said anchor end of said rope;

said passage in said shoe being located on a side of said body portion that is towards said fairlead when said shoe is in said locked position, so that said rope passes under said lower end of said body portion and is directed towards said fairlead from an upper end of said passage, and a greatest portion of weight of said body portion of said shoe being located on a side of said body portion that is away from said fairlead when said shoe is in said locked position, so that said weight of said body portion urges said shoe to pivot downwardly from said unlocked position towards said locked position.

2. The anchor rope lock of claim 1, wherein said body portion of said locking shoe comprises:

a block-shaped body having said horizontal axis at an upper corner thereof.

3. The anchor rope lock of claim 2, wherein said block-shaped body comprises:

a block-shaped weight formed of substantially solid metal.

4. The anchor rope lock of claim 1, wherein said toe portion comprises:

an upper side at which said anchor rope exits said passage towards said fairlead.

5. The anchor rope lock of claim 4, wherein said fairlead comprises:

a rope-supporting portion that is elevated relative to said upper side of said toe portion of said shoe, so that said anchor rope tends at an upward angle therefrom.

6. The anchor rope lock of claim 5, wherein said rope-supporting portion of said fairlead comprises:

a sheave of a roller fairlead.

7. The anchor rope lock of claim 1, wherein said toe portion of said locking shoe comprises:

a lower surface that extends from and is substantially continuous with said lower surface on said body portion of said shoe.

8. The anchor rope lock of claim 7, wherein said upper surface of said base plate is substantially flat and horizontal, and wherein said lower surfaces of said body and toe portions of said locking shoe are curved so diverge upwardly from said upper surface of said base plate towards a distal end of said toe portion when said shoe is in said locked position.

9. The anchor rope lock of claim 8, wherein said lower surface on said body portion further comprises:

an angled corner at an end of said lower surface opposite said toe portion of said shoe, for pressing into said rope thereunder when said shoe is in said locked position.

10. The anchor rope lock of claim 8 wherein said passage in said toe portion of said locking shoe extends in a substantially vertical direction perpendicular to said upper surface of said base plate when said shoe is in said locked position.

11. The anchor rope lock of claim 10, wherein said passage in said toe portion of said locking shoe comprises:

an inside chamfer at an upper end of said opening for protecting said rope from damage against said opening.

12. An anchor rope lock, comprising:

a frame, comprising:

an elongate base plate having a substantially flat, horizontal upper surface for passage of an anchor rope thereover in a generally horizontal direction; and first and second substantially parallel, spaced apart side plates mounted to said base plate so as to extend upwardly therefrom, so that in combination said base and side plates define an elongate channel;

a locking shoe mounted between said side plates on a horizontal pivot proximate a first end of said elongate channel, said locking shoe comprising:

a block-shaped, substantially solid body portion having said pivot axis at an upper corner thereof so that a greatest portion of weight of said locking shoe is on a side of said pivot axis towards said first end of said channel;

a shallow toe portion protruding from a lower end of said body portion towards a second end of said channel;

a lower surface formed on a lower end of said body portion and said toe portion for compressing said rope against said upper surface of said base plate when in a locked position, said lower surface facing towards said upper surface of said base plate when said shoe is in said locked position and curving upwardly therefrom towards a distal end of said toe portion; and a passage through said toe portion for forcing said rope into a bend when said shoe is in said locked position, said passage extending in a vertical direction substantially perpendicular to said upper surface of said base plate when said shoe is in said locked position; and a fairlead roller mounted between said side plates on a horizontal axle proximate said second end of said channel, said fairlead roller comprising:

a sheave that is elevated relative to said locking shoe so that said rope tends at an upward angle from said distal end of said toe portion of said locking shoe to said sheave of said fairlead roller when said shoe is in said locked position.

13. The anchor rope lock of claim 12, wherein said block-shaped body portion further comprises:

a lower corner of said block opposite said upper corner having said pivot axis, that form an angled corner at an end of said lower surface of said locking shoe for pressing into said rope when said shoe is in said locked position.

14. The anchor rope lock of claim 13, wherein said block-shaped body portion comprises:

a generally rectangular, vertically elongate block having said protruding toe portion formed integrally with said lower end thereof.

15. A locking shoe for an anchor rope lock, said locking shoe comprising:

a block-shaped, substantially solid body portion having a horizontal pivot axis at an upper corner thereof so that a greatest portion of weight of said locking shoe is on a first side of said pivot axis;

a shallow toe portion protruding from a lower end of said body portion on a second, opposite side of said pivot axis;

a lower surface formed on a lower end of said body portion and said toe portion for compressing an anchor rope thereunder, said lower surface curving upwardly towards a distal end of said toe portion; and a passage through said toe portion for forcing said rope into a bend, said passage extending in a direction generally normal to said lower surface of said body portion of said shoe.

16. The locking shoe of claim 15, wherein said body portion further comprises:

a lower corner opposite said corner having said pivot axis, that forms an angled corner at an end of said lower surface of said shoe for pressing into said rope as said rope is compressed thereunder.

* * * * *